US005865538A

United States Patent [19]

Walker et al.

[11] Patent Number: 5,865,538

[45] Date of Patent: Feb. 2, 1999

[54] CONTAINERIZED BATCH MIXER

[75] Inventors: Thomas R. Walker, Dover; Brian P. Duffy, Dallastown, both of Pa.

[73] Assignee: Readco Manufacturing, Inc., York, Pa.

[21] Appl. No.: 851,094

[22] Filed: May 5, 1997

[51] Int. Cl.[6] ..... B01F 7/16; B01F 9/08

[52] U.S. Cl. ..... 366/197; 366/213; 366/218; 366/209; 366/219

[58] Field of Search ..... 366/197, 198, 366/199, 206, 208, 209, 213, 218, 219, 233, 244, 245, 246, 247, 249, 250, 252, 251, 347

[56] References Cited

U.S. PATENT DOCUMENTS

| | | | |
|---|---|---|---|
| 838,661 | 12/1906 | Stadtmuller . | |
| 1,367,732 | 2/1921 | Christensen . | |
| 1,702,512 | 2/1929 | Karlson | 366/197 |
| 1,761,237 | 6/1930 | Schiff | 366/197 |
| 3,176,967 | 4/1965 | Hartley . | |
| 3,374,584 | 3/1968 | Haught | 51/164 |
| 4,004,783 | 1/1977 | Wilson . | |
| 4,077,613 | 3/1978 | Wilson . | |
| 4,100,616 | 7/1978 | Wilson . | |
| 4,468,129 | 8/1984 | McIntosh et al. | 366/213 |
| 4,676,658 | 6/1987 | Herfeld | 366/197 |
| 4,781,468 | 11/1988 | Herfeld | 366/213 |
| 4,884,245 | 11/1989 | McIntosh et al. | 366/250 |
| 4,957,373 | 9/1990 | Derksen et al. | 366/219 |
| 5,123,747 | 6/1992 | Derksen | 366/197 |

*Primary Examiner*—Tony G. Soohoo
*Attorney, Agent, or Firm*—Morgan, Lewis & Bockius LLP; C. Scott Talbot; Howard R. Richman

[57] ABSTRACT

An improved containerized batch mixer is disclosed. The mixer container is loaded with particulate material and the lid assembly is locked in place. The container is then rolled onto the mixing station where left and right forks on the lower docking arm assembly slide into left and right container rails on the container assembly. The docking arm drive assembly is then activated to start the lower docking arms on their upward path. A screw jack turns to slowly raise the lower docking arms. Left and right fork guide pins engage left and right guide holes on the container support frame. The mixing container's spear point is axially aligned with an impeller drive socket by a guide stop collar. Finally, as the lower docking arms travel toward the upper docking arm, the spear point rotationally engages drive socket. During operation, the docking assembly is rotated about a horizontal rotation axis by a motor while an impeller mounted within the mixing container is rotated about an initially vertical axis of rotation by a drive motor.

13 Claims, 20 Drawing Sheets

CONTAINERIZED BATCH MIXER

BACKGROUND OF THE INVENTION

The invention relates generally to mixing and more particularly to a method and apparatus for mixing in which mixing containers holding the material to be mixed and the mixing impeller are releasably coupleable to a mixing drive station and in which the material is mixed in the container by rotation about the impeller about one axis of rotation while the entire container is rotated about another axis of rotation. This type of mixer is commonly referred to as a containerized batch mixer with multiple axes of rotation. Containerized batch mixers are especially useful for mixing particulate matter with or without the addition of liquids.

One known containerized batch mixer with multiple axes of rotation is disclosed in U.S. Pat. No. 4,468,129 to McIntosh et al. The mixer of McIntosh includes a cylindrical container with a built in mixing impeller and spear point, a docking station, upper and lower docking arms to move the container and engage the spear point with a drive mechanism, and multiple motors to rotate the impeller as well as the container. During the operation of this mixer, the container is loaded and closed prior to being mounted in the mixing station. The container is then lifted via the hydraulic docking arms to an operating position. In this operating position, the drive mechanism is engaged with the spear point of the impeller. The impeller is then rotated while the container itself is concurrently rotated.

A conventional containerized batch mixer 10 is illustrated in FIGS. 1A, 1B and 2. The mixer includes base 11 (which may be fixed to the ground), motor 12, rotational shaft 13, which rotates around horizontal rotation axis 14, docking assembly 15 and drive coupling assembly 20. The docking assembly 15 includes fixed upper docking arms 16, hydraulic lift cylinders 17, moveable lower docking arms 18, and container docking pads 30 (see FIG. 1B).

The drive coupling assembly 20 consists of drive motor 19, drive belt 21, drive shaft and spring-loaded collar 22 and drive socket 23. The drive socket 23 is designed to rotationally engage the drive end of the mixing container's impeller (spear point) about an initially vertical axis of rotation 29. The terminology "initially vertical" has been used to describe vertical axis 29 because once the docking assembly begins to rotate about the horizontal axis of rotation, vertical axis of rotation 29 also rotates about the horizontal axis of rotation.

The mixer 10 is shown in FIG. 2 with mixing container 24, which includes an impeller with mixing blades 25, a cylindrical skirt or false bottom 26, an impeller drive end or spear point 27 and an impeller shaft bearing assembly 28. The mixing container is shown in the loading position in FIG. 2. The container 24 is loaded onto the mixer 10 by rolling the container between lower docking arms 18 until the top of the container rests against container docking pad 30. The hydraulic lift cylinders 17 are then activated to move the lower docking arms 18 upward to engage the false bottom 26 of container 24. The hydraulic lift cylinders 17 then continue to raise the container 24 towards fixed upper docking arms 16. Impeller drive end or spear point 27 then enters drive socket 23 of drive coupling 20. When spear point 27 is fully engaged with drive socket 23, spring-loaded collar 22 of drive coupling 20 takes up further axial translation of the container and lower docking arms 18 until they reach the upper limit of their range of movement, identified as the operating position.

During operation, the docking assembly 15 is rotated about horizontal rotation axis 14 by motor 12 while the impeller with mixing blades 25 is rotated about the vertical axis of rotation 29 by drive motor 19.

The prior art containerized batch mixers described above work well and have been commercially successful, but suffer from several shortcomings. The mixers are relatively mechanically complex, and therefore costly to manufacture. The complexity arises from several sources. First is the lower docking arm which has a complex geometry and must be custom manufactured to fit the container utilized in the mixer. Second is the hydraulic drive system for the lower docking arm, which entails hydraulic pumps, tubing, and actuators and entails the risk of potentially contaminating leakages of hydraulic fluid. Further, the use of a hydraulic drive poses the risk that a sudden loss in power or hydraulic pressure would cause the lower docking arm to travel away from the fixed upper docking arm, which could allow the still rotating container to become separated from the mixing station. To address this risk, a backup, mechanical retention system, such as locking pins that fix the lower docking arm to the vertical support, are used. These locking pins must be custom located to fit each vessel's individual configuration. A third source of mechanical complexity and attendant cost is that the container must be formed with a cylindrical skirt, or false bottom, to provide a lower horizontal bearing surface by which the container can be supported by the lower docking arm. Fourth is the drive coupling, which is designed to accommodate axial misalignment and relative axial positioning of the drive socket and the container's spear point. The potential for axial misalignment arises from the imprecise positioning of the container on the lower docking arm and the lower docking arm relative to the drive coupling. The drive coupling is also designed to absorb relative axial movement of the spear point with respect to the drive motor as the container is brought into its fully raised position and after the spear point has engaged the drive socket of the drive coupling. The flexible, spring-loaded drive socket is mechanically complex and not as robust as could be desired to accommodate the increasing demands for mixing torque and power.

There is therefore a need to provide a mechanically simpler, more efficient, and less expensive containerized batch mixer.

SUMMARY OF THE INVENTION

The shortcomings of the prior art devices identified above are addressed by the mixing method and apparatus of the invention. The containerized batch mixer of the invention has a docking assembly consisting of a movable docking arm and a fixed docking arm, a rigid drive coupling and a circumferential guide collar for placing the container and the rigid drive coupling in proper axial alignment. One set of the docking arms of the invention contains forks to engage hollow rails on the mixing container. The forks on the docking arms also contain guide pins which pass through holes in the rails to further align the container and the rigid drive coupling. A rigid drive coupling is surrounded by a concentric collar that guides the container spear point into axial alignment with the drive socket, forms an axial stop to define the upper, operating position of the container in appropriate relative axial position with the drive socket, and serves as an upper contact point for clamping engagement of the container between the upper and lower docking arms. The spear point and drive socket have mating drive teeth that ensure rotational alignment and engagement of the drive coupling and the spear point. The movable docking arm is driven by a screw-jack. The use of the above-described configuration eliminates the need for a redundant, uniquely located, locking pin arrangement when the mixing container is placed in an operating position.

DETAILED DESCRIPTION

Figure 1A:
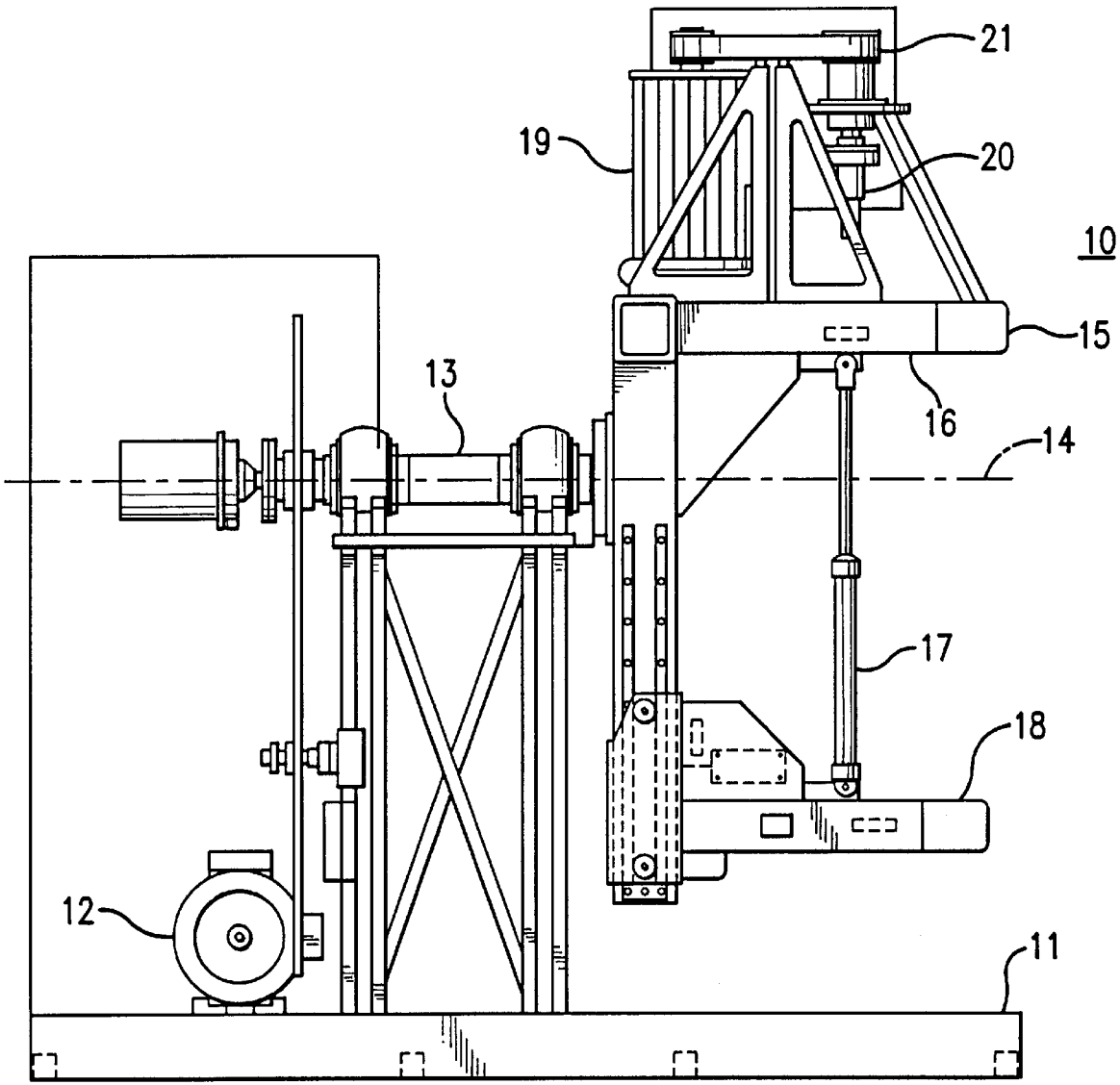
FIG. 1A PRIOR ART
FIG. 1A is a side view of a prior art containerized batch mixer with multiple axes of rotation.
Figure 1B:
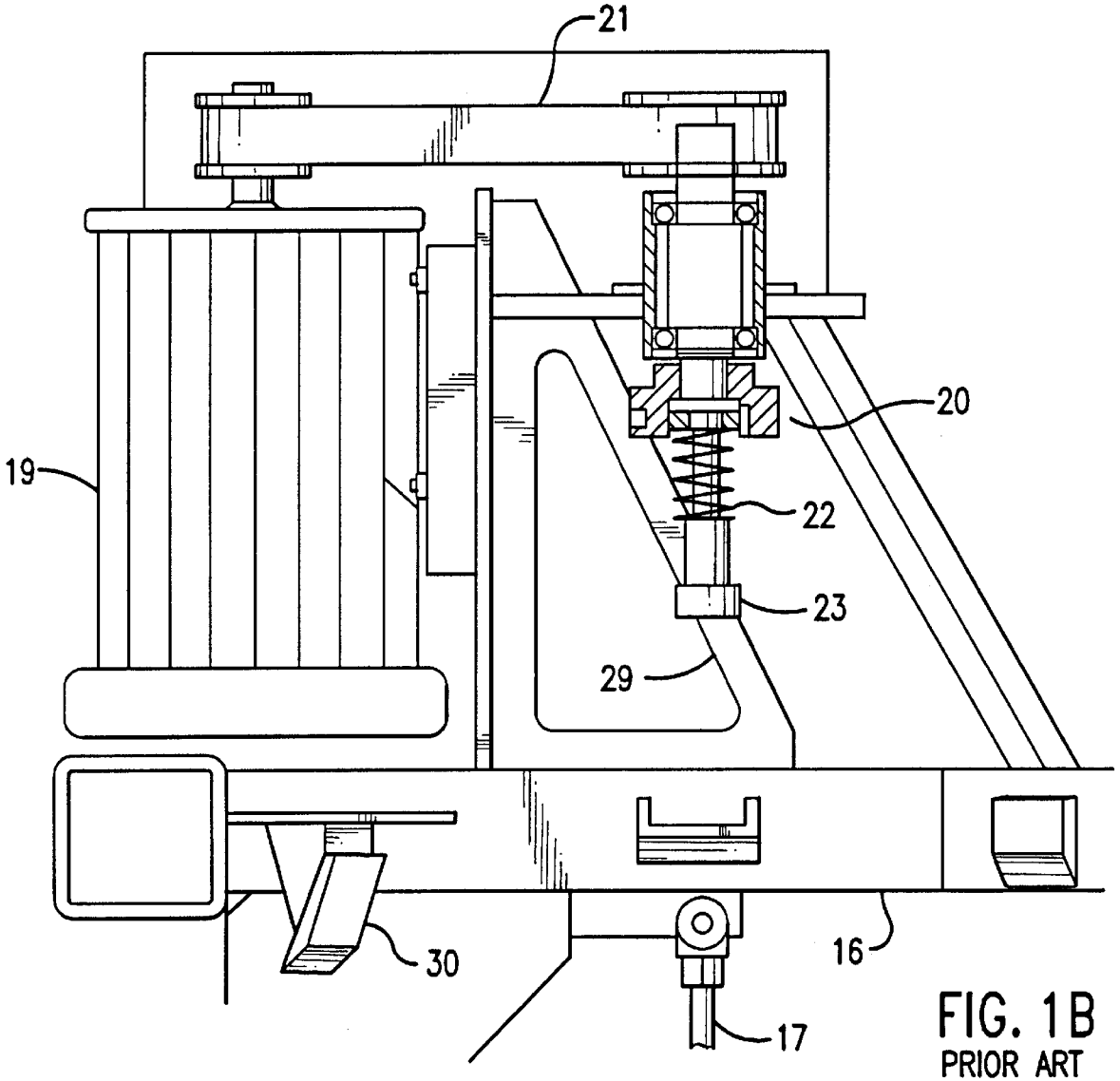
FIG. 1B PRIOR ART
FIG. 1B is an enlarged detail of the drive coupling assembly of the mixer of FIG. 1A.
Figure 2:
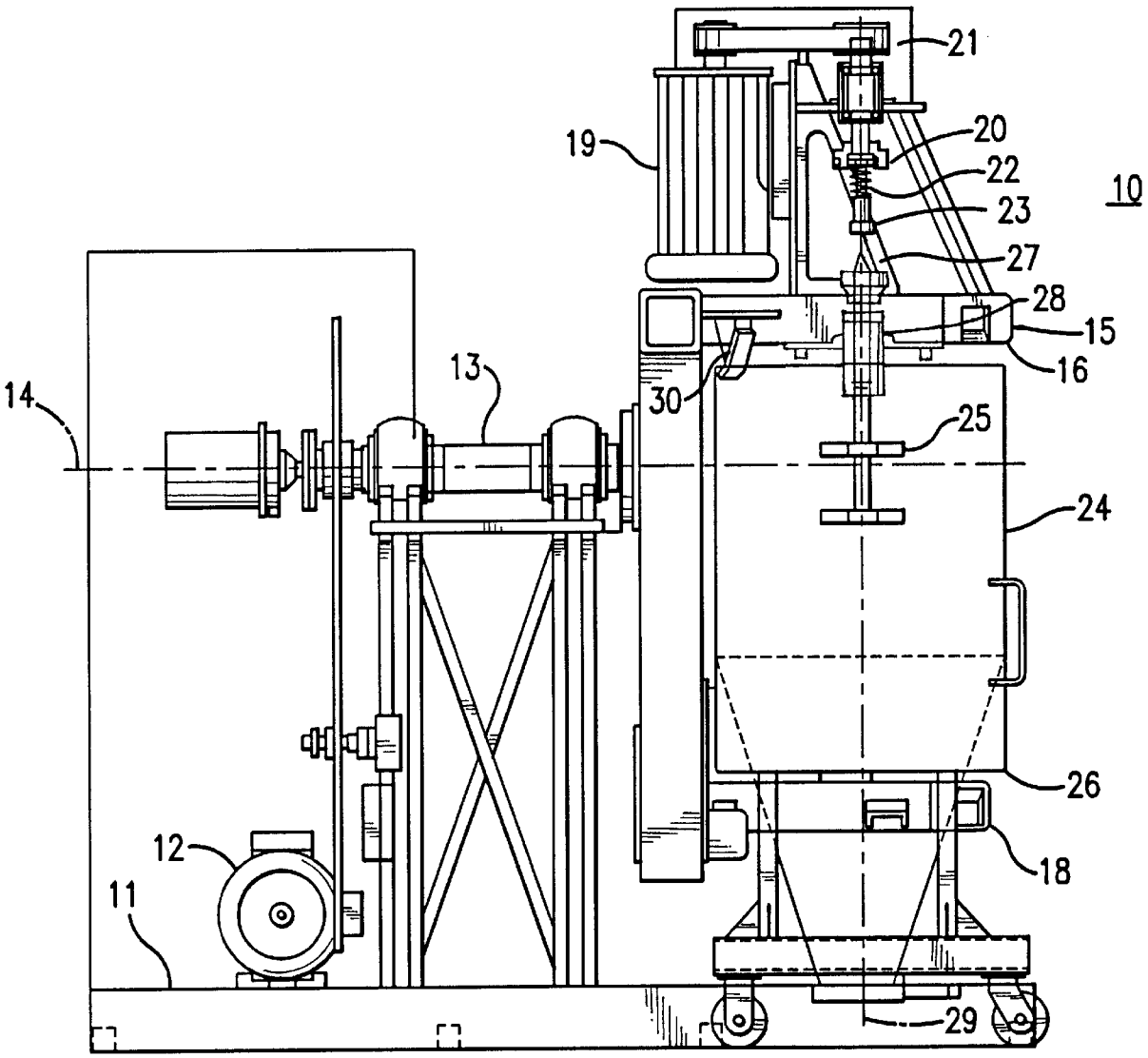
FIG. 2 PRIOR ART
FIG. 2 is a side view of the mixer of FIG. 1A including the mixing container in the loading position.
Figure 3A:
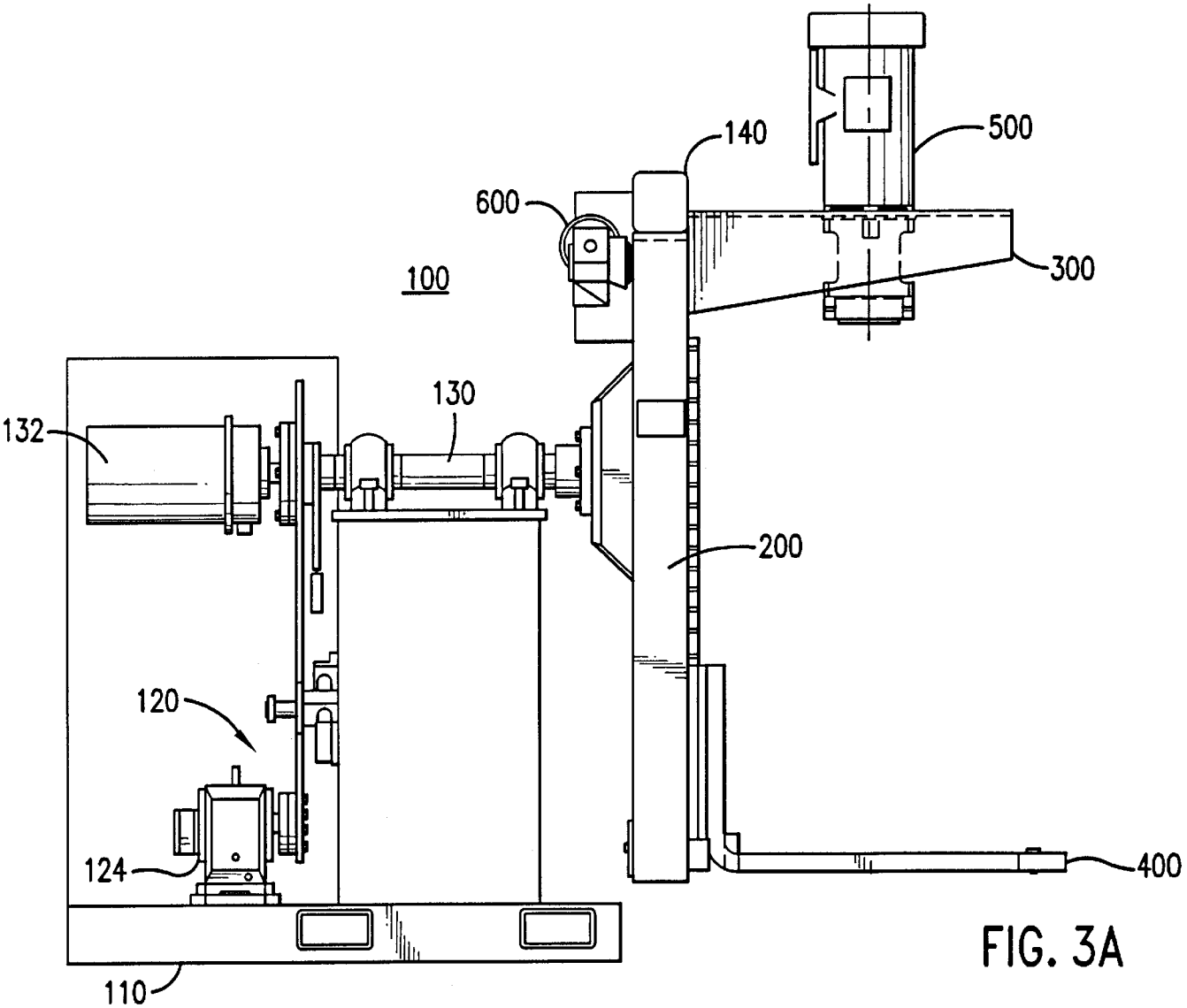
FIGS. 3A and 3B are side and front views, respectively, of a containerized batch mixer embodying the principles of the invention.
Figure 3B:
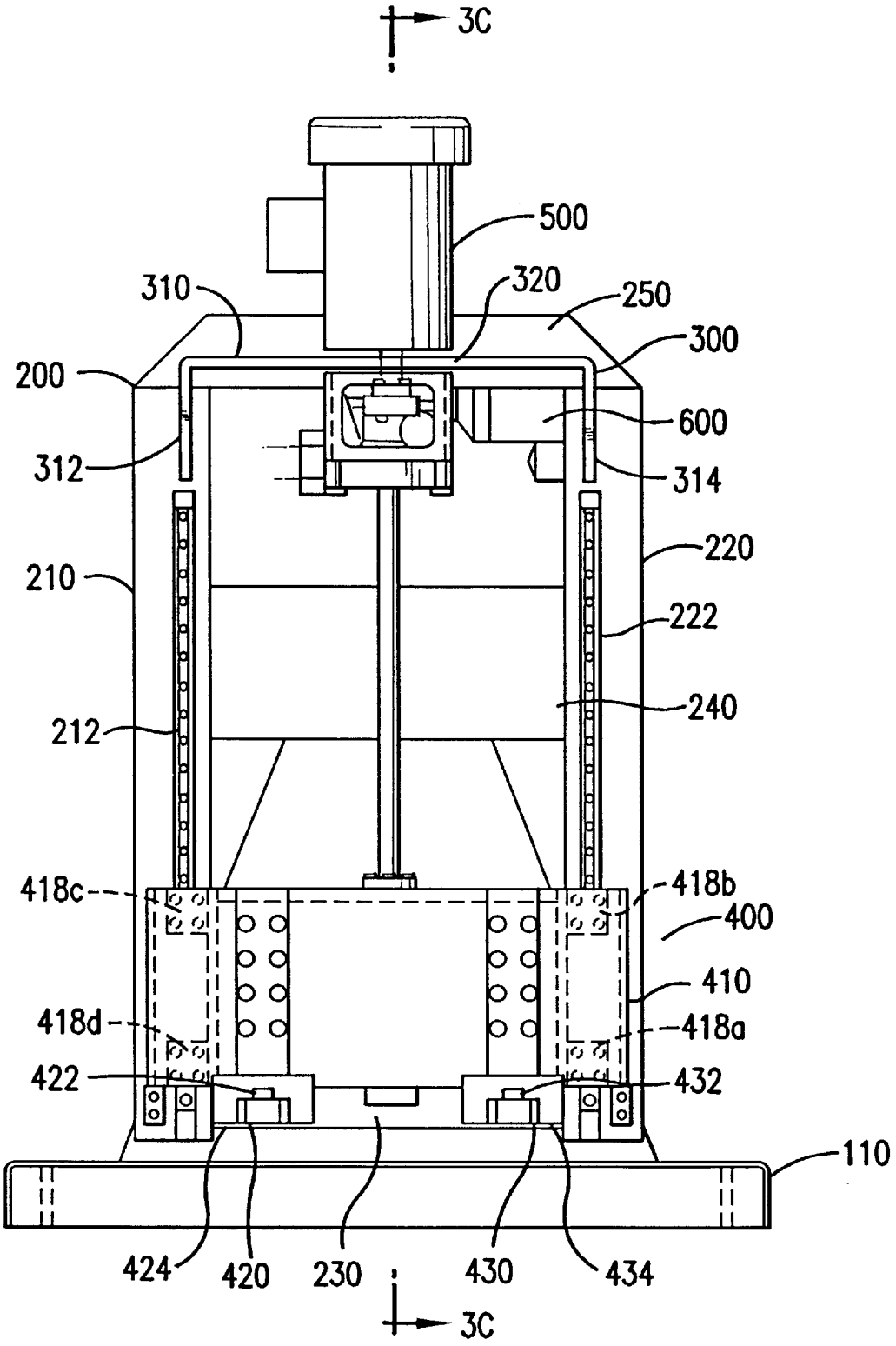

A mixing station embodying the principles of the invention is illustrated in FIGS. 3A–B. Mixing station 100 includes a base 110, a horizontal drive assembly 120, and a docking assembly 140. Horizontal drive assembly 120 rotates docking assembly 140 about horizontal rotation axis 132 with a drive motor 124 rotating horizontal shaft 130.

Docking assembly 140 includes a vertical support 200, an upper docking arm 300, a lower docking arm 400, an impeller drive assembly 500 and a docking arm drive assembly 600. Vertical support 200 is a generally rectangular box structure with left rail 210, right rail 220, lower cross member 230, middle cross member 240 and upper cross member 250. Middle cross member 240 extends rearwardly from the rear face of vertical support 200, and is coupled to the end of horizontal shaft 130. Left and right lower docking arm bearing ways 212, 222 are mounted to the front faces of the left and right rails 210, 220, respectively.

Upper docking arm 300 projects forwardly from the upper end of vertical support 200, and is generally U-shaped, with a horizontal, planar main body 310 and with left flange 312 and right flange 314 projecting downwardly from the left and right sides, respectively, of main body 310, and tapering upwardly from rear to front. An annular drive mount 320 is formed in the central portion of main body 310. Annular drive mount 320 consists of a reinforcing plate welded in place to provide increased structural rigidity to the portion where the drive assembly 500 is mounted (see FIG. 6).

Figure 5:
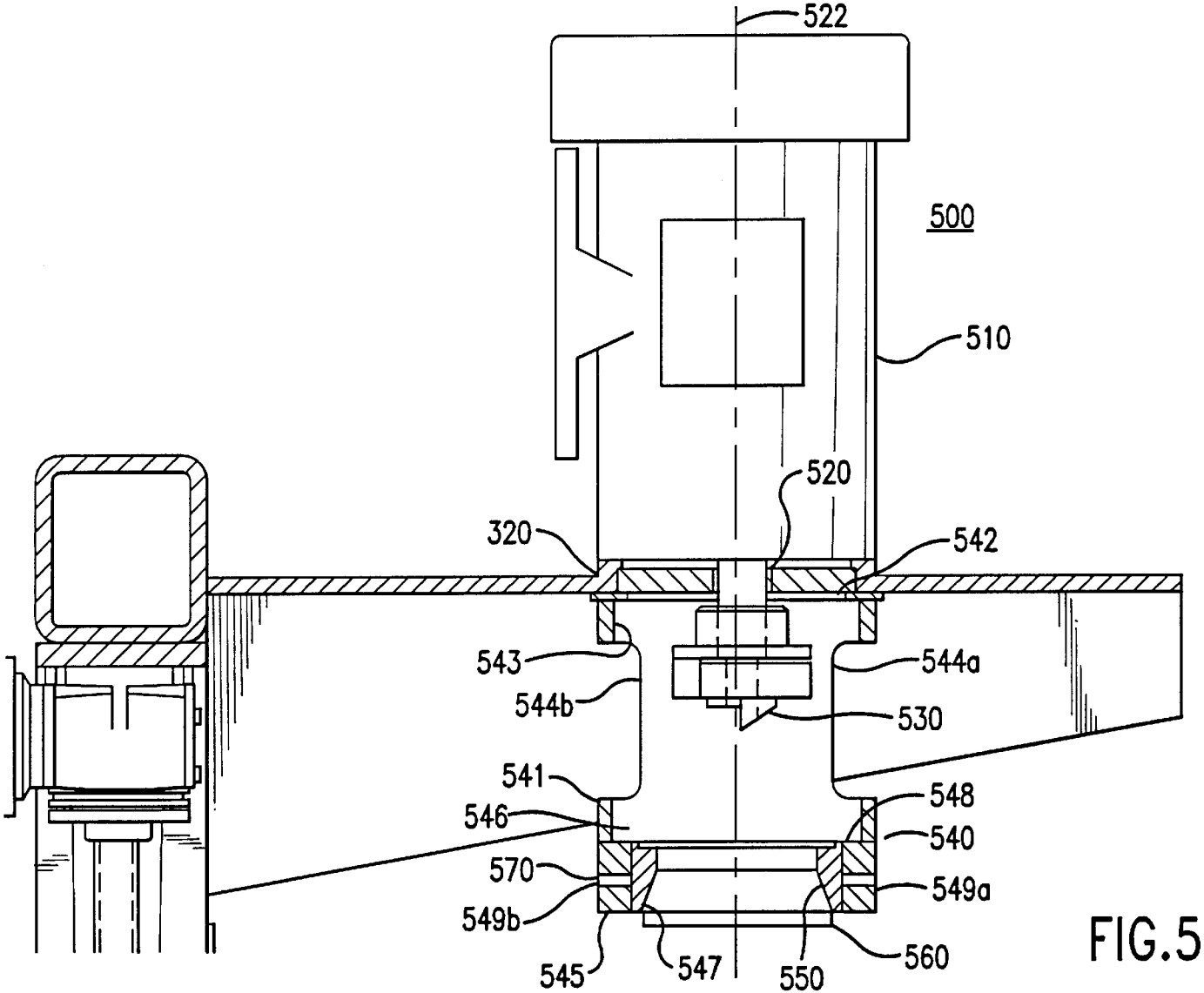
FIG. 5 is a partial, sectional, side view of the drive coupling assembly of the mixer of FIG. 4.
Figure 6:
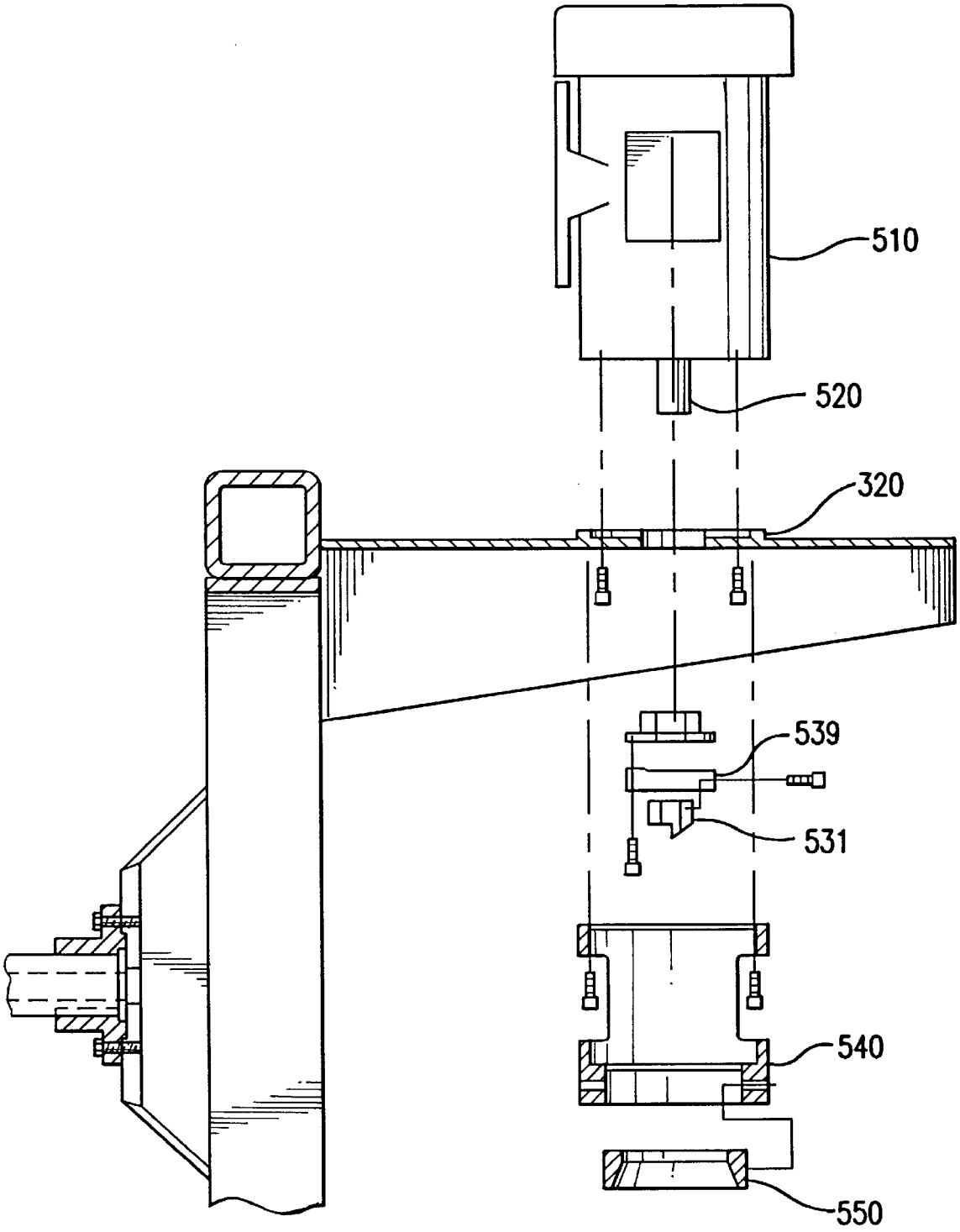
FIG. 6 is an exploded view of FIG. 5.
Figure 12A:
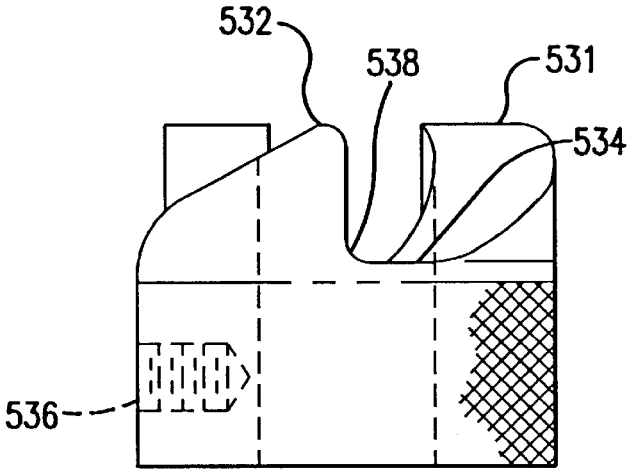
FIG. 12A is a schematic side view of the drive socket of the drive coupling of FIGS. 3A–3B.
Figure 12B:
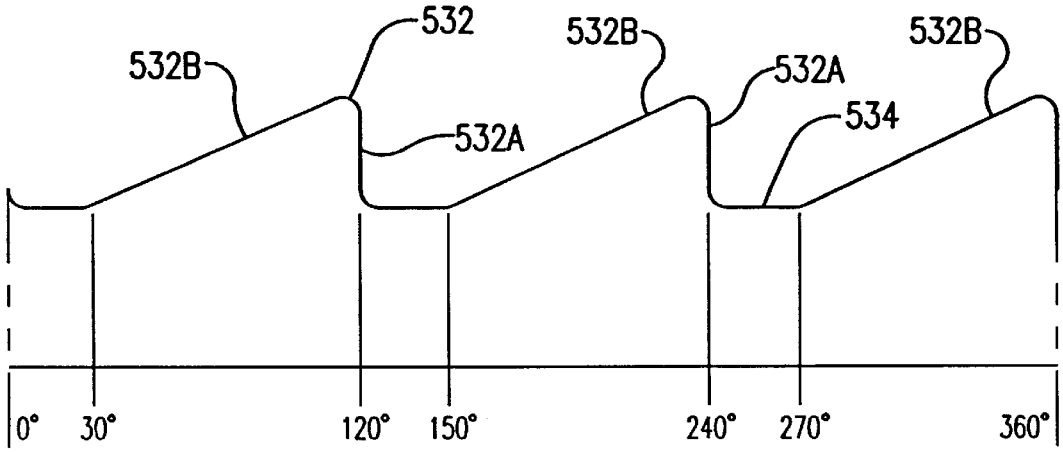
FIG. 12B is a schematic view of the circumferential profile of the drive socket of FIG. 12A.

As shown in FIGS. 5 and 6, impeller drive assembly 500 and guide stop collar assembly 540 are mounted to opposite sides of drive mount 320. Impeller drive assembly 500 includes impeller drive motor 510, impeller drive shaft 520, and impeller drive coupling 530. As shown in FIGS. 12A and 12B, drive coupling 530 includes a drive socket 531 and a retaining collar 539 (see FIG. 6), which is fixed to the lower end of drive shaft 520. Drive socket 531 is generally cylindrical and annular, with a central bore 538, and has a series of ridges 532 and indentations 534 disposed about the periphery of its lower end. Ridges 532 include a vertically-oriented drive face 532A and angled alignment faces 532B. Internally threaded fastener bore 536 penetrates the outer surface of socket 531 radially inwardly. Socket 531 is mounted in collar 539 by engagement of a suitable fastener (in the disclosed embodiment, a set screw) with fastener bore 536. Drive socket 531 and drive shaft 520 are coaxially aligned with, and define, a vertical drive rotation axis 522.

Guide stop collar assembly 540 is mounted to the lower side of drive mount 320 concentrically about drive coupling 530 and includes a guide stop collar body 541, guide ring 550, two stop pads 560 and two guide ring retainers 570. Guide stop collar body 541 is generally cylindrical, with an upper end 542, cylindrical side wall 543 with front and rear openings 544A, 544B therethrough, and a lower end 545. Lower end 545 is formed with a thicker wall than the remainder of guide stop collar 540, and includes a stepped internal bore with a large diameter bore portion 546, a small diameter bore portion 547, and a horizontal shoulder 548 separating the bore portions. Front and rear retainer bores 549A, 549B, respectively, radially penetrate lower end 545 and open into small diameter bore portion 547 and are internally threaded.

Figure 7:
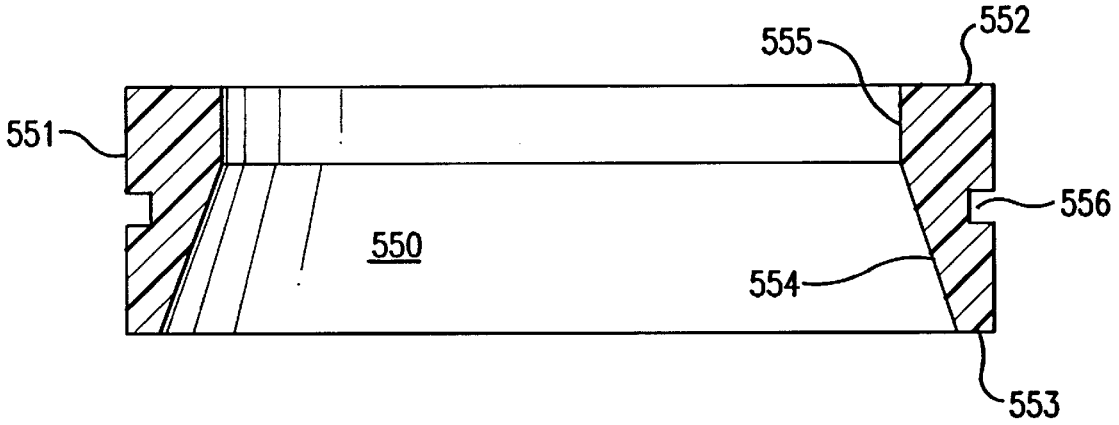
FIG. 7 is an enlarged side view of the guide collar of FIG. 5.

As shown in FIG. 7, guide ring 550 is an annular, cylindrical body with an upper end 552, lower end 553, outer cylindrical surface 551 with a peripheral retention groove 556, a tapered inner bore with a lower, tapered bore portion 554 and an upper, cylindrical bore portion 555. Guide ring 550 is mounted in small diameter bore portion 547 of with its upper end disposed adjacent shoulder 548, and is retained in guide stop collar 540 by engagement of guide retainers 570 with retention groove 556. In the disclosed embodiment, guide retainers 570 are externally threaded set screws which are threaded into retainer bores 549A, 549B. Guide ring 550 is preferably formed from a wear resistant material such as nylon.

Figure 8:
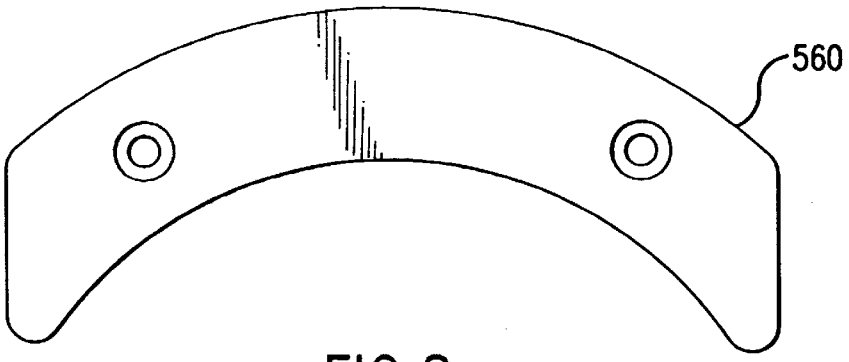
FIG. 8 is a plan view of the stop pad of FIG. 5.

As shown in FIG. 8, stop pads 560 are arcuate and planar, and formed with a pair of fastener holds. In the disclosed embodiment, stop pads 560 are mounted to the bottom of guide stop collar 540 by screws, but can be attached by any suitable connector, preferably removably. Stop pads 560 are preferably formed from a wear resistant material such as nylon.

Figure 3C:
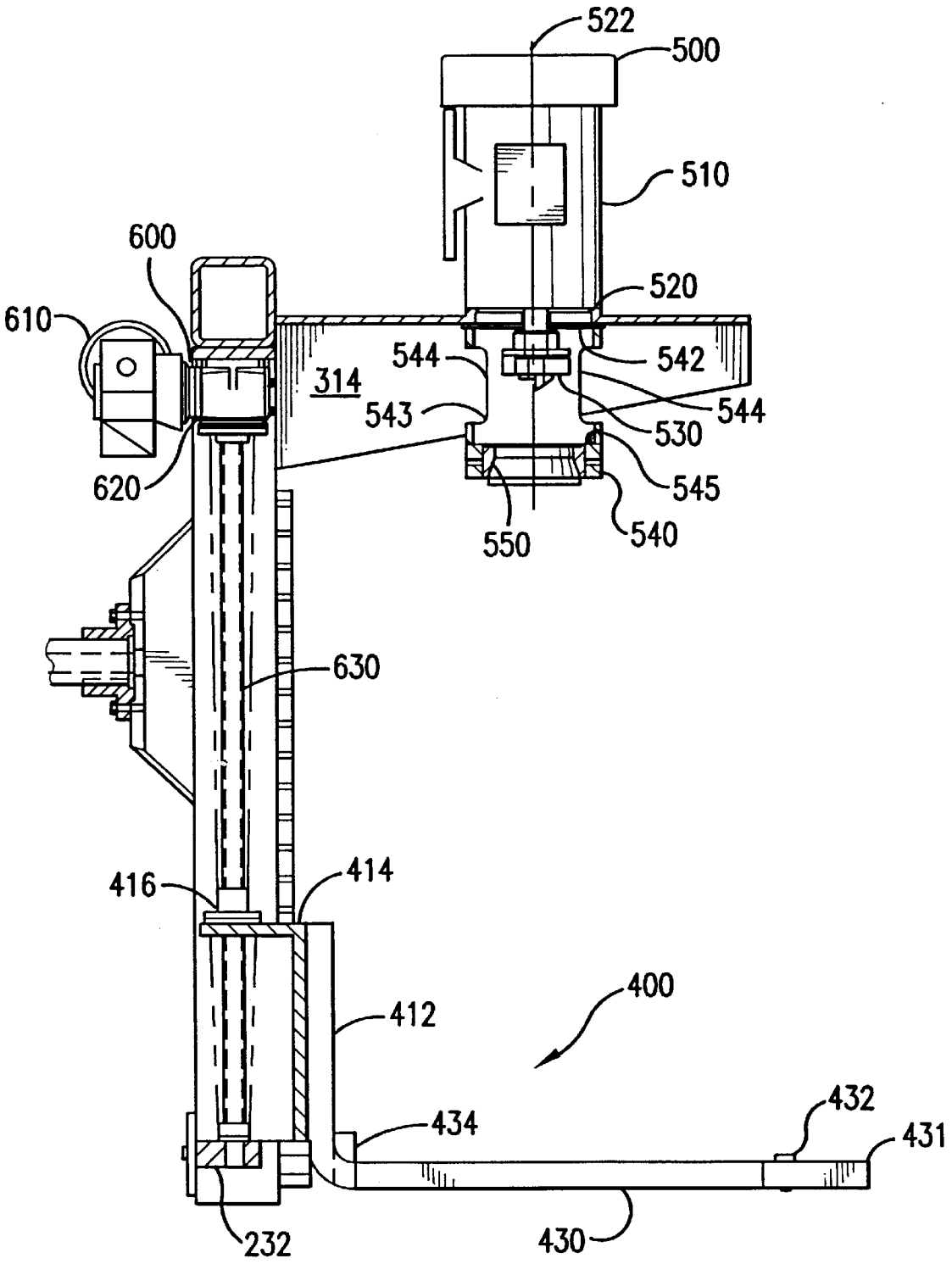
FIG. 3C is a partial sectional side view of the mixer of FIGS. 3A and 3B taken along 3C—3C of FIG. 3B.

Returning to FIGS. 3A–3C, lower docking arm 400 includes a body portion 410 and left fork 420 and right fork 430 projecting forwardly from the lower front portion of body portion 410. Body portion 410 includes a generally planar vertical portion 412, a horizontal flange 414 and screw coupling collar 416 centrally mounted in horizontal flange 414. Four rollers 418A, 418B, 418C, and 418D are mounted to the rear face of vertical portion 412 for rolling engagement with bearing ways 212, 222.

Right fork 430 includes a right guide pin 432 projecting vertically upwardly from the upper surface of the fork near its distal end 431, and has a generally rectangular right stop block 434 projecting above the upper surface of right fork 430 at the fork's opposite, proximal end. Similarly, left fork 420 includes left guide pin 422 at the left fork distal end 421 and a left stop block 424.

The lower docking arm drive assembly 600 includes a motor 610, a gear coupling 620 and screw shaft 630. Screw shaft 630 passes through, and threadedly engages, screw coupling collar 416, and is rotatably seated at its lower end in screwjournal 232. Rotation of screw shaft 630 by motor 610 via gear coupling 620 translates lower docking arm 400 vertically.

The components of the docking assembly are preferably made from carbon steel, but may be constructed of any other suitable material.

Figure 9:
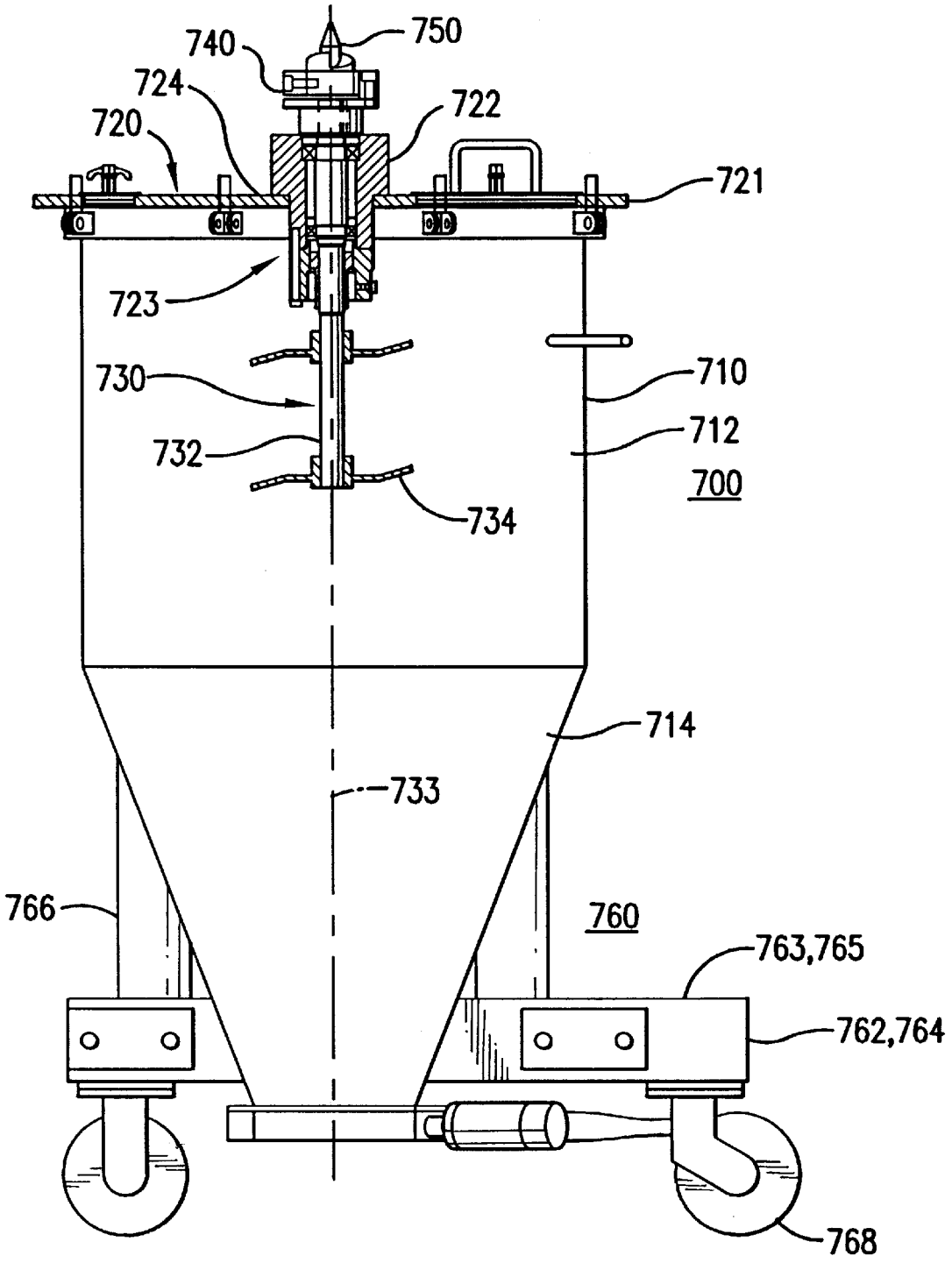
FIG. 9 is a side view of the mixing container of FIG. 4.

The mixing container assembly 700 and its operative engagement with mixer 100 is illustrated with reference to FIGS. 4, 9, 10A, 10B and 11A–B. As shown in FIG. 9, mixing container assembly 700 includes container body 710, lid assembly 720, impeller 730, coupling 740, spear point 750, and support frame 760.

Container body 710 has a cylindrical upper portion 712 and a frustoconical lower portion 714. It is supported at the lower portion 714 by support frame 760, which includes left and right container rails 762 and 764 respectively, vertical support posts 766 coupled at their lower ends to the upper surfaces of rails 762 and 764 and at their upper ends to container body 710. Four casters 768 are mounted to the lower surfaces of rails 762 and 764. Left and right guide holes 763 and 765, respectively, are formed in the upper surfaces of the rails and are dimensioned to receive the left and right guide pins 422 and 432 of the lower docking arms.

Figure 10A:
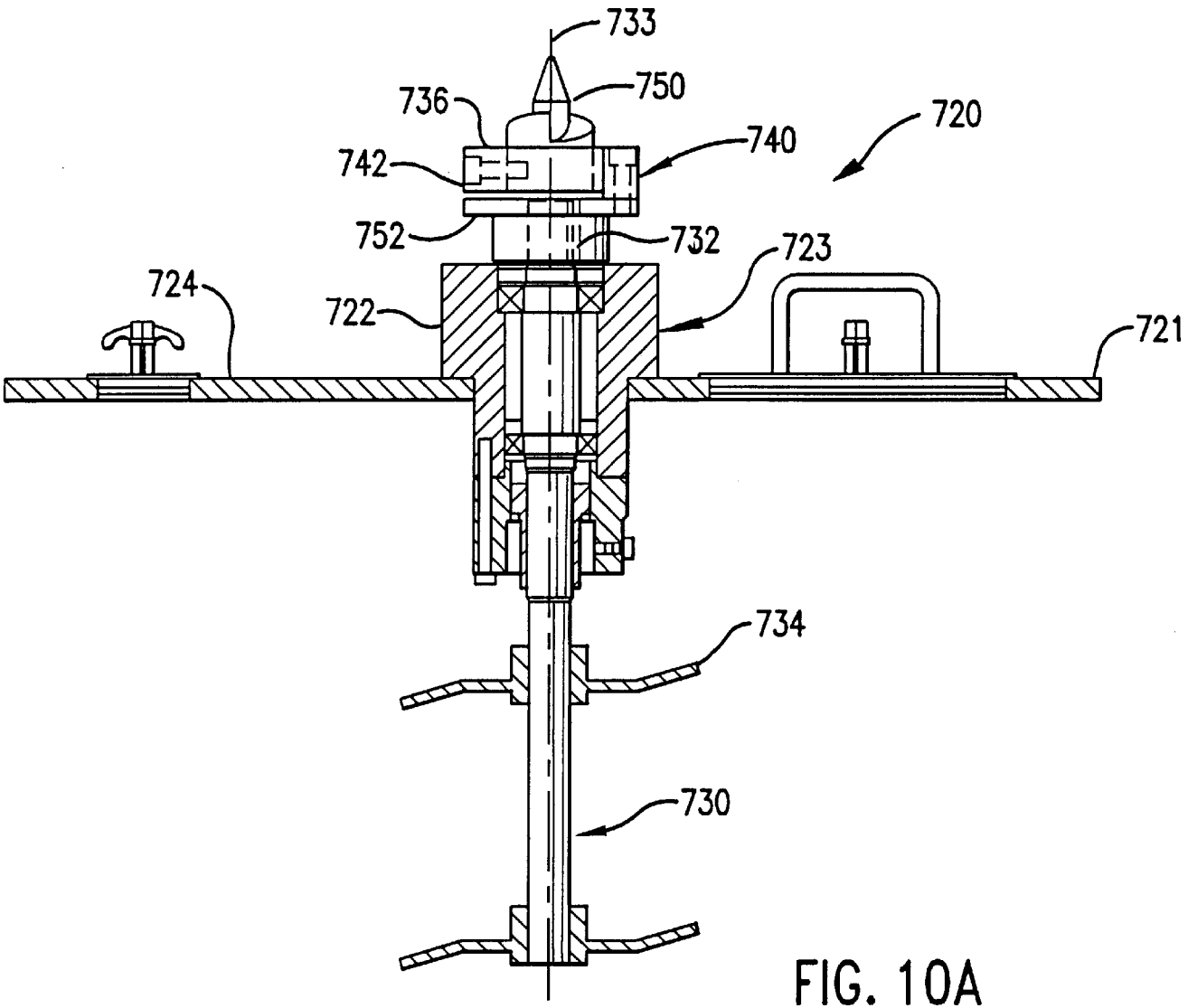
FIG. 10A is a side view of top portion and impeller assembly of the mixing container of FIG. 4.

As shown in FIGS. 9 and 10A, lid assembly 720 has a generally planar, disk-shaped lid plate 721 that is releasably coupled at its perimeter to the upper end of container body 710 by conventional clamps or other suitable connectors. Lid assembly 720 also includes an impeller support assembly 723, which supports the impeller 730 for rotation in suitable, conventional bearings, and includes a cylindrical bearing block 722, which projects upwardly above the upper surface 724 of lid plate 721.

Figure 10B:
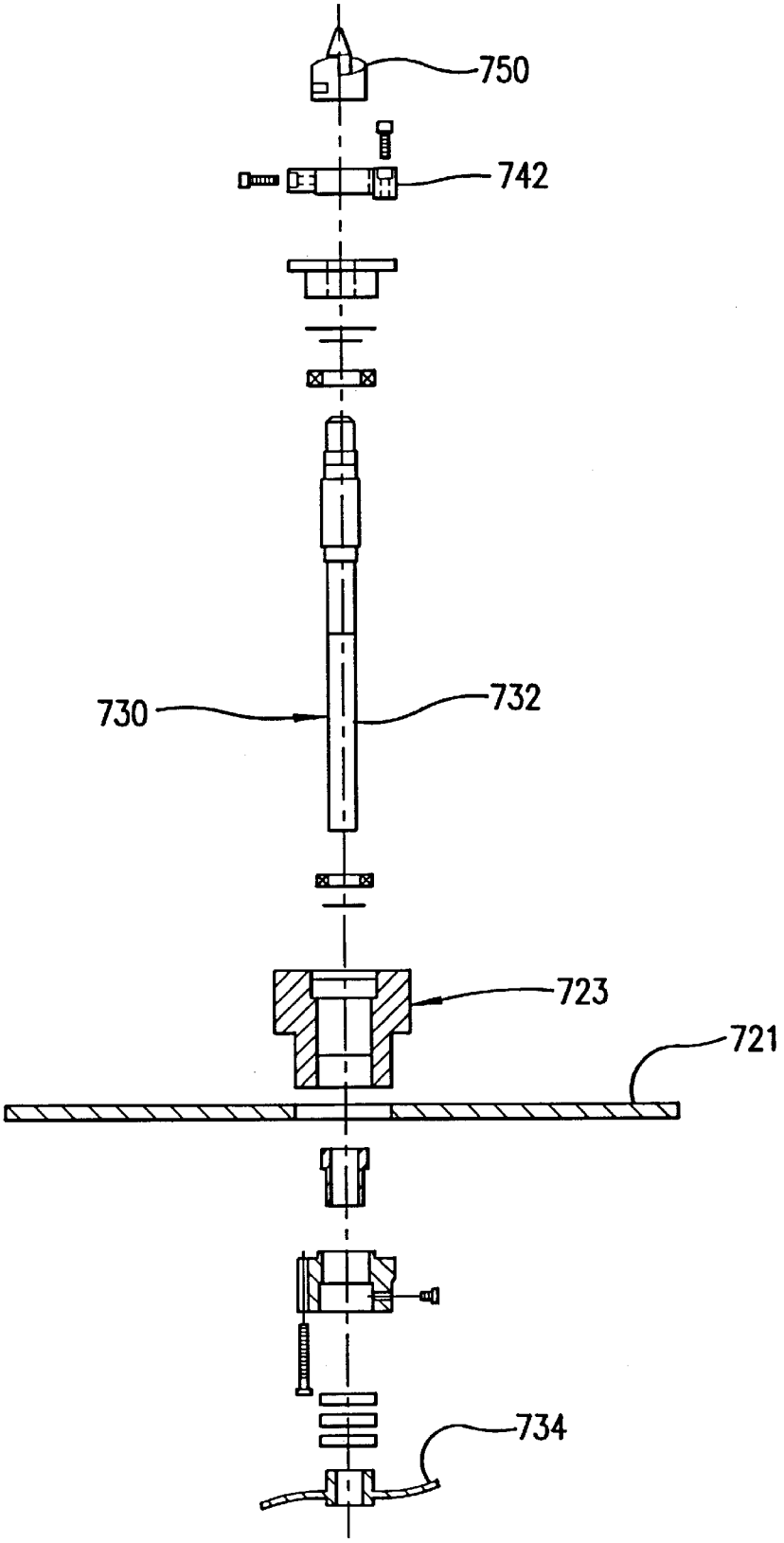
FIG. 10B is an exploded view of the top portion of the impeller assembly of FIG. 10A.

As shown in FIG. 10B, impeller 730 is of conventional design, and includes an impeller shaft 732 and mixing blades 734 projecting radially outwardly from shaft 732. Shaft 732 is journaled at its upper end in support assembly 723. Coupling 740 is fixed to the upper end of shaft 732 and includes lower plate 752 (attached to shaft 732), retainer collar 736, and elastomeric coupler 742, which couples lower plate 752 to retainer collar 736 and serves to reduce the transmission of shock loads on the impeller to the spear point (and thence to the impeller drive).

Figure 11A:
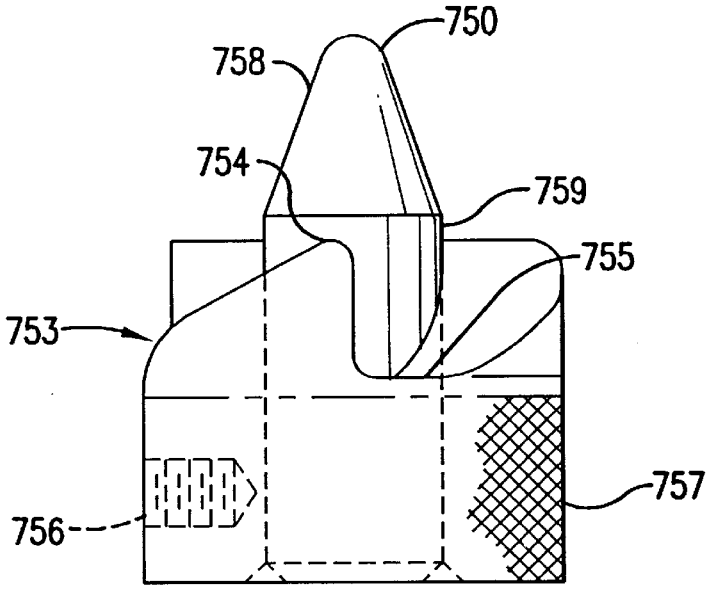
FIG. 11A is a side view of the impeller spear point of the impeller shown in FIG. 10A.
Figure 11B:
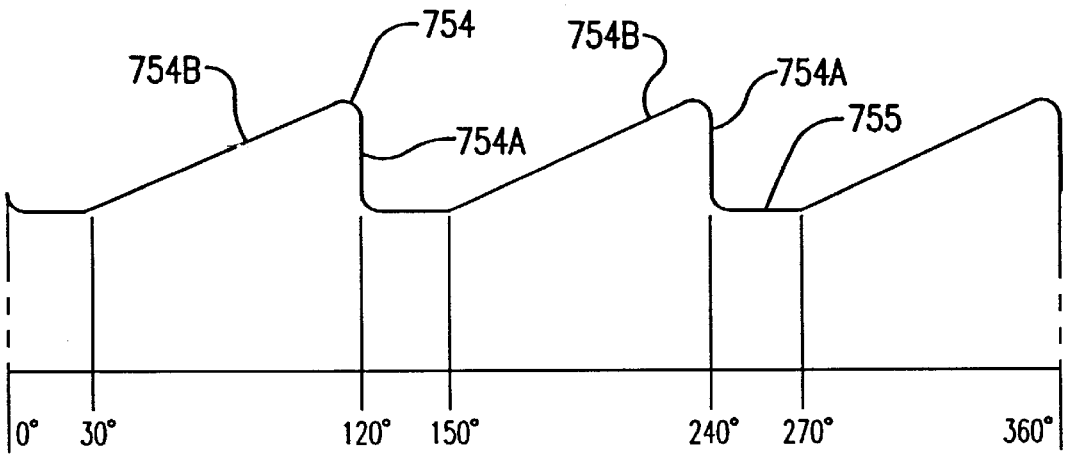
FIG. 11B is a schematic view of the circumferential profile of the impeller spear point of FIG. 11A.

Spear point 750 (shown in detail in FIG. 11A) has a cylindrical lower portion 757, a shoulder portion 753 formed with a series of ridges, an upper cylindrical portion 759, and a conical vertex portion 758. Internally threaded fastener bore 756 penetrates the outer surface of lower portion 757 radially inwardly. The profile of the ridges 754 and indentations 755 is shown in FIG. 11B. Ridges 754 include a vertically-oriented drive face 754A and angled alignment faces 754B. Spear point 750 is mounted in retainer collar 736 by engagement of a suitable fastener (in the disclosed embodiment, a set screw) with fastener bore 756. Spear point 750 and impeller shaft 732 are coaxially aligned with, and define, an impeller axis of rotation 733.

Spear point 750 and drive socket 531 (see FIG. 12A) are configured to mesh together to transmit torque from the impeller drive shaft 520 to the impeller shaft 732 by engagement of the respective drive faces 532A and 754A. If the spear point and drive socket are brought together axially in a rotational orientation in which the drive faces are not rotationally aligned, alignment faces 532B and 754B engage and urge the spear point and drive socket into the correct relative rotational orientation.

The container assembly components are preferably made from a corrosion resistant and non-reactive material such as stainless steel. The elastomeric coupler 742 is preferably made from natural rubber or other suitable elastomer. Spear point 750 and drive socket 530 are preferably made from case-hardened carbon steel.

Figure 4:
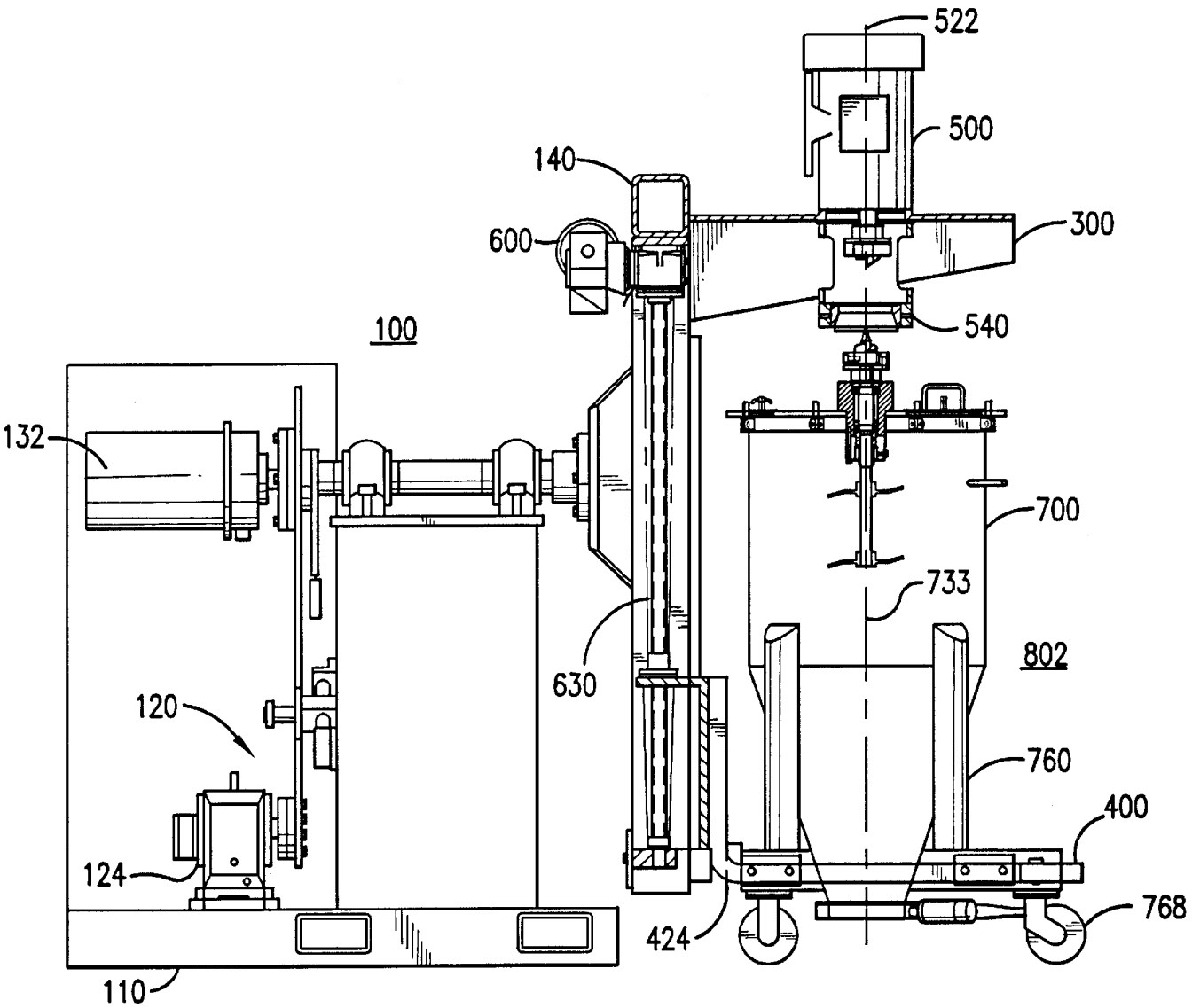
FIG. 4 is a side view of the mixer of FIGS. 3A and 3B with a mixing container in the loading position.

The operation of the containerized batch mixer is described with reference to FIGS. 4 and 13A–E. Mixer container 700 is loaded with particulate material and lid assembly 720 is locked in place. The container is then rolled into place in the mixing station (as shown in FIGS. 4 and 13C) with left and right forks 420 and 430 of the lower docking arm 400 disposed within left and right container rails 762 and 764 of the container assembly 700, and with the rear ends of the container rails abutting left and right stop blocks 424 and 434. In this initial position, left and right guide pins 422 and 432 are positioned below left and right guide holes (763, 765) in the container rails, and the container is disposed with the impeller axis of rotation 733 approximately aligned with impeller drive axis of rotation 522. The docking arm drive 600 is then activated to start the lower docking arm on its upward path. Screw 630 turns and the lower docking arm rises. Left and right guide pins 422 and 432 engage the left and right guide holes (763, 765), bringing the axes of rotation 522 and 733 into somewhat closer alignment.

Figure 13A:
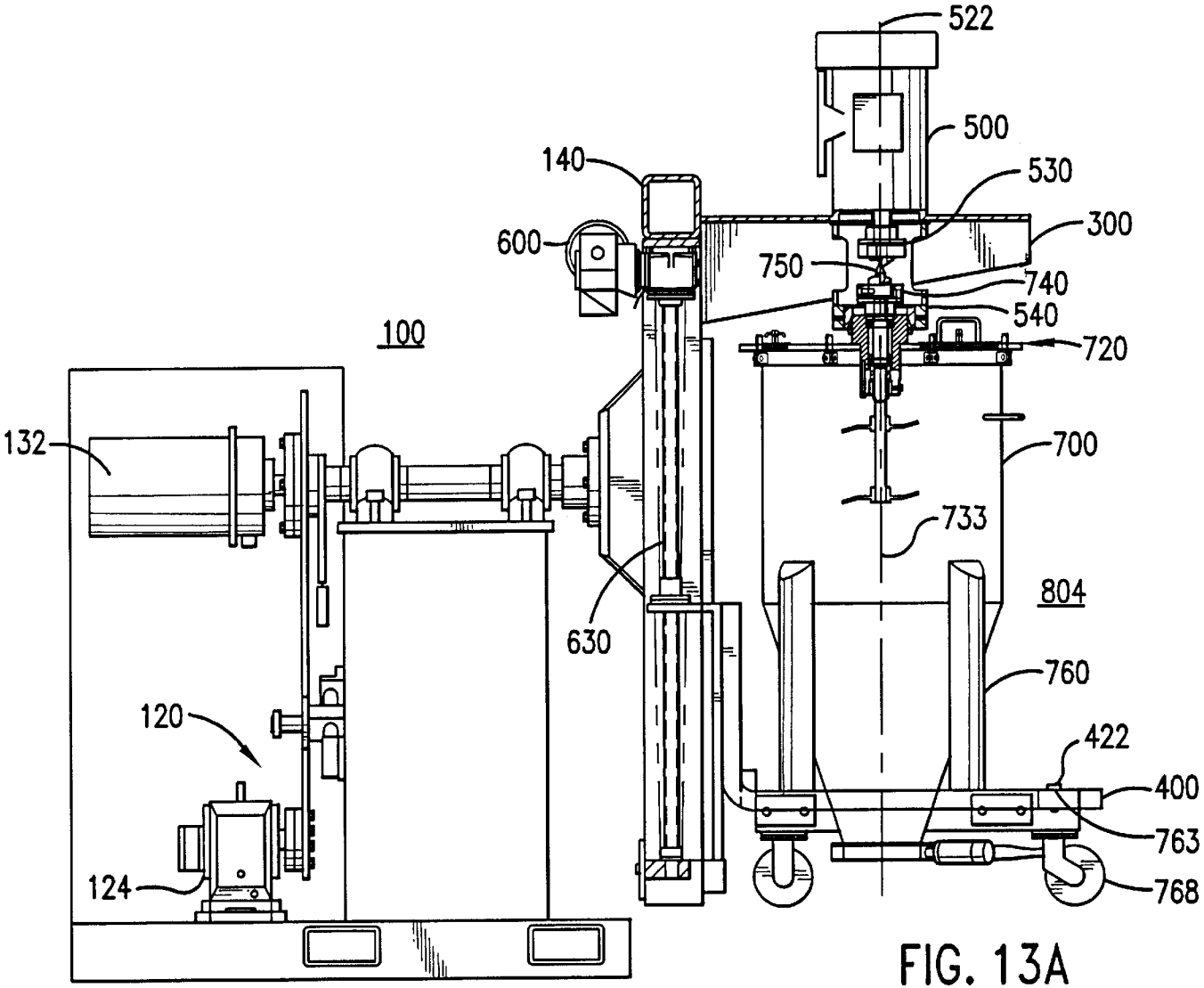
FIG. 13A is a side view of the mixer of FIG. 4 with the mixing container in an intermediate position.
Figure 13B:
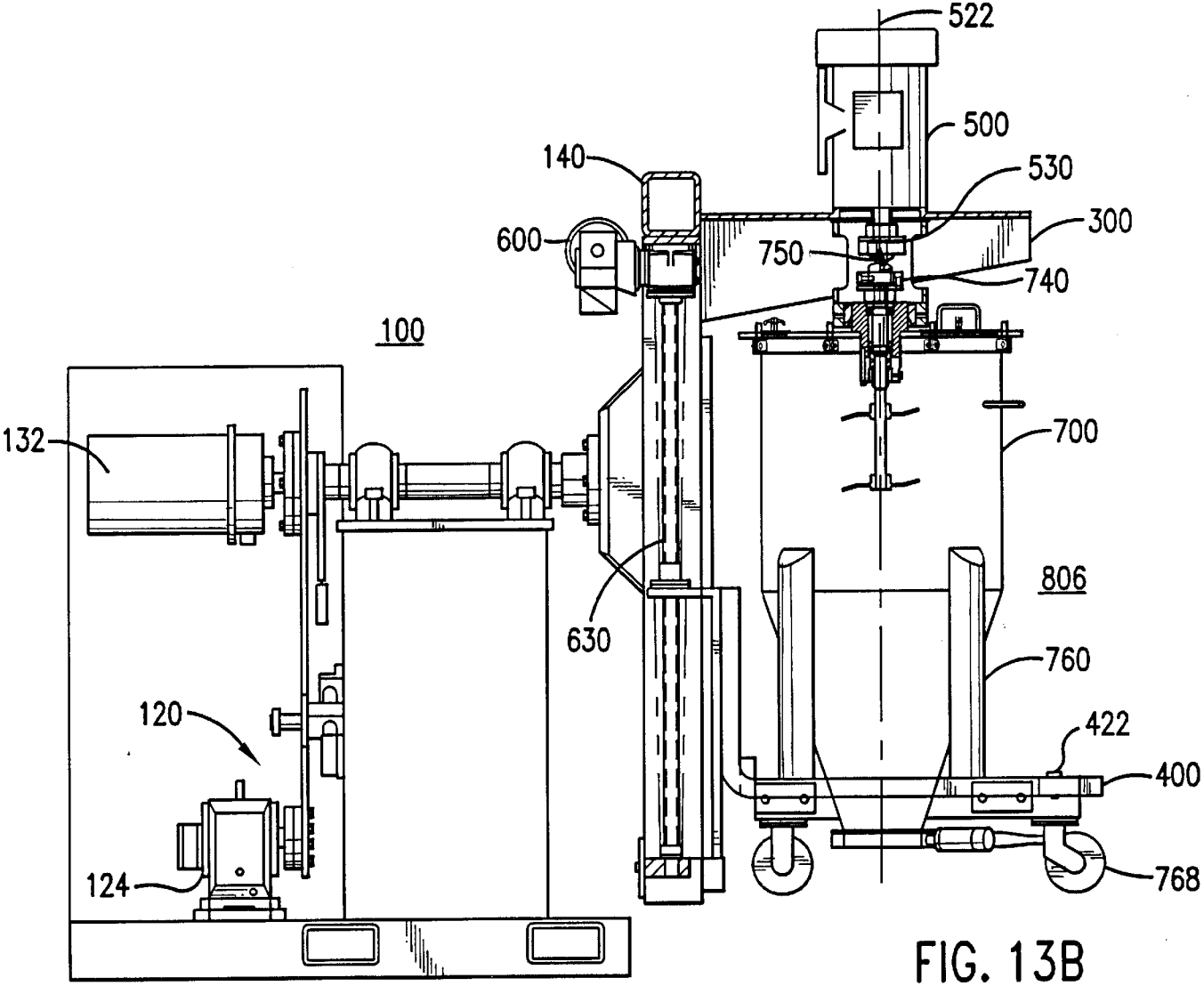
FIG. 13B is a side view of the mixer of FIG. 4 with the mixing container fully engaged in the operating position.
Figure 13C:
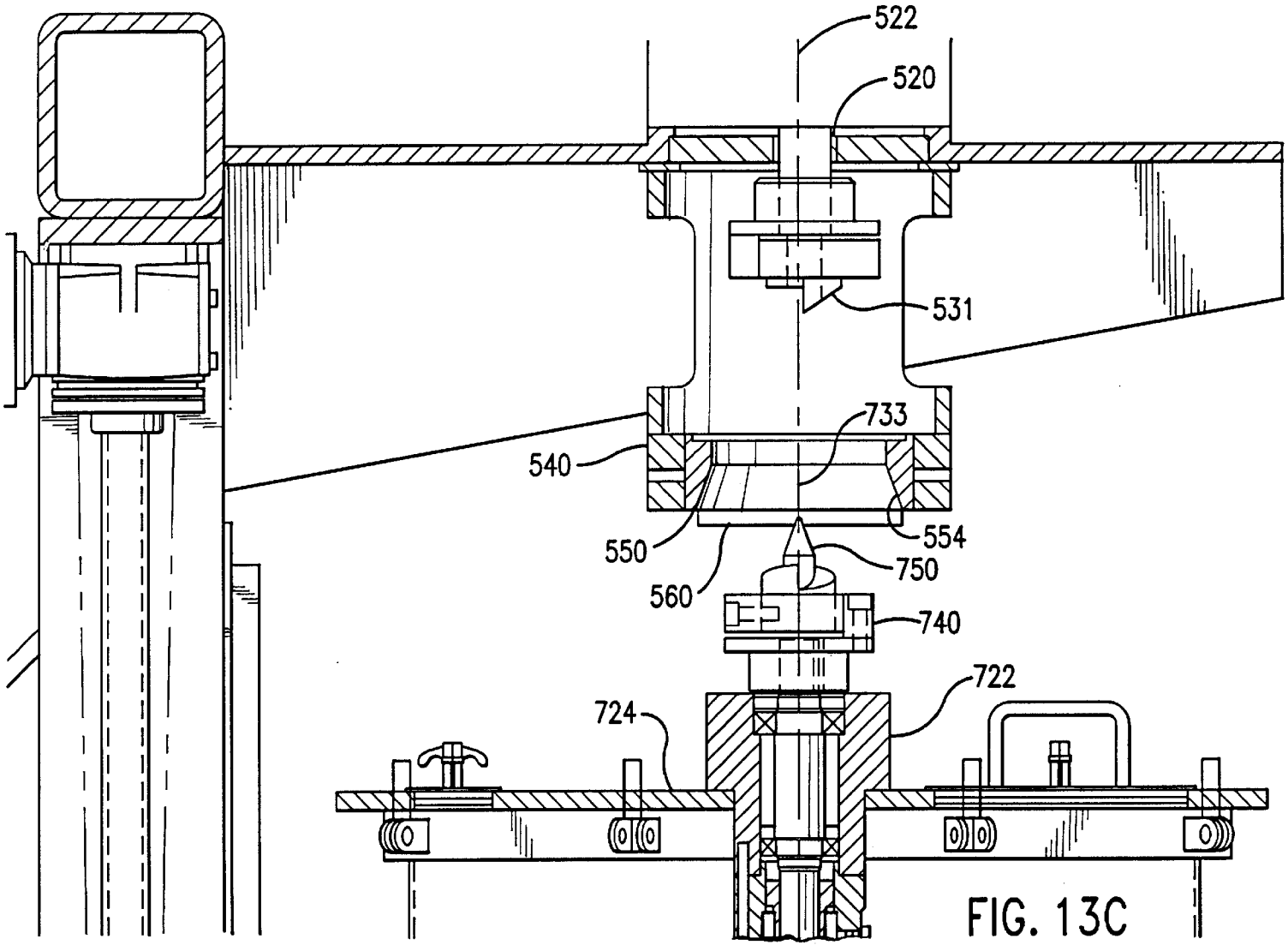
FIG. 13C is an enlarged partial side view of the drive coupling assembly and mixing container of the mixer of FIG. 4 with the mixing container in the loading position.
Figure 13D:
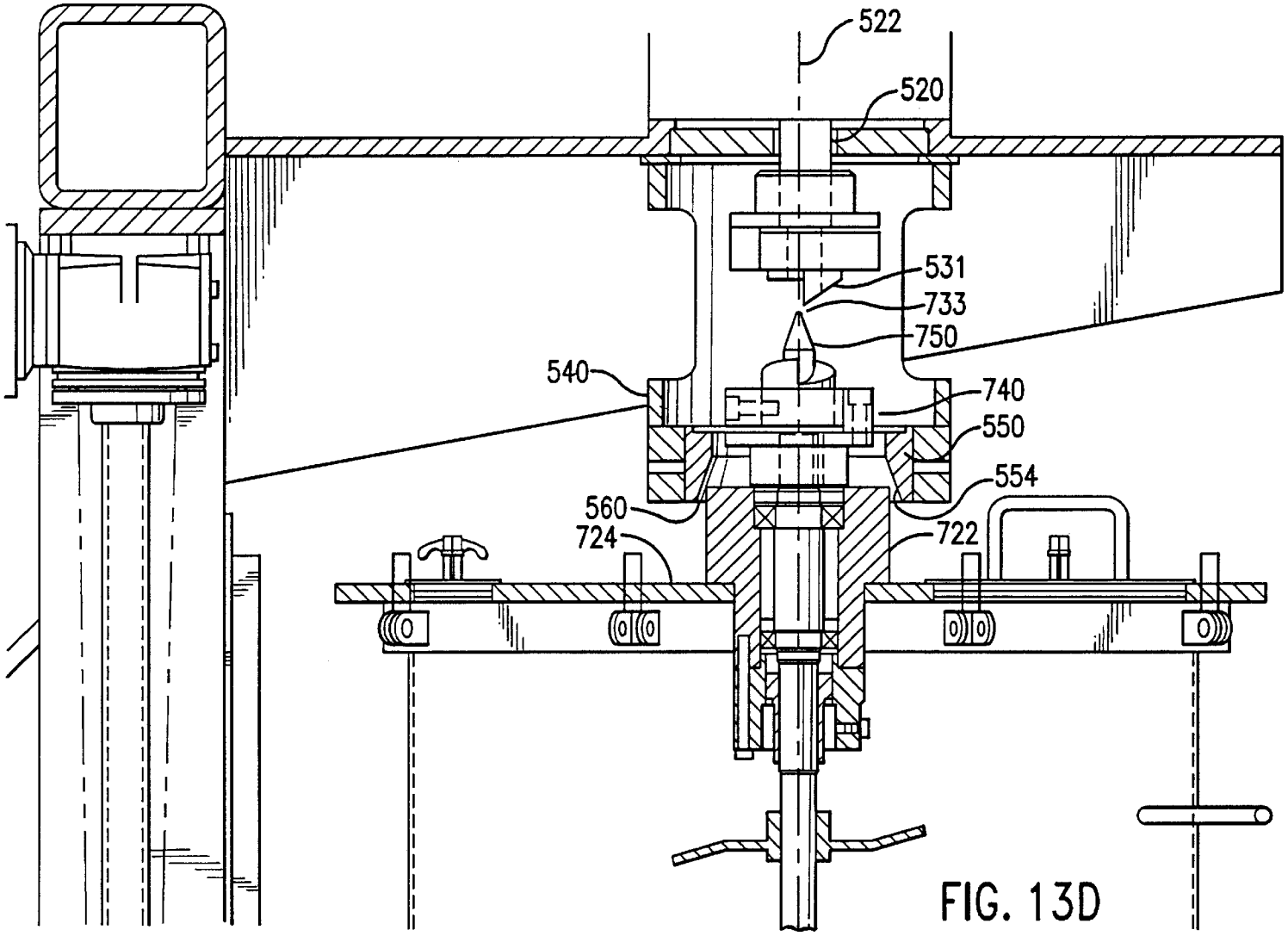
FIG. 13D is an enlarged partial side view of the drive coupling assembly and mixing container of the mixer of FIG. 13A with the mixing container in an intermediate position.
Figure 13E:
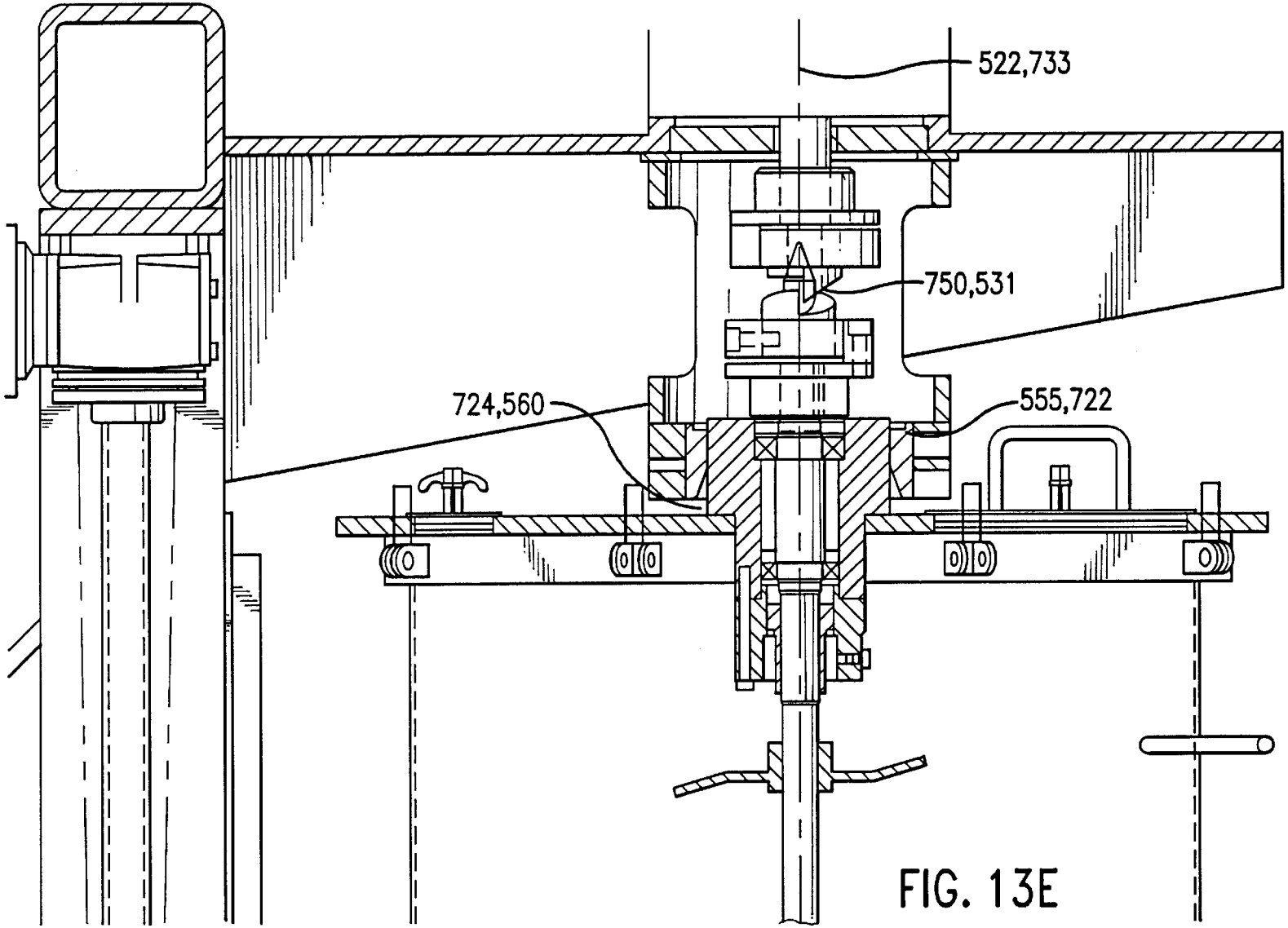
FIG. 13E is an enlarged partial side view of the drive coupling assembly and mixing container of the mixer of FIG. 13B with the mixing container fully engaged in the operating position.

As the lower docking arm rises further, coupler 740 and spear point 750 enter the tapered bore portion 554 of guide stop collar 540 (see FIGS. 13A and 13D). Any remaining axial misalignment of axes of rotation 522 and 733 is corrected by engagement of the upper corner of bearing block 722 with tapered bore portion 554 and the ensuing close radial engagement of the outer surface of bearing block 722 with the inner surface of upper bore portion 555 of guide ring 550. The bearing block slides axially within upper bore portion 555 as the lower docking arm rises further, and the vertex 758 of spear point 750 enters central bore 538 of drive socket 531 and, if there is rotational misalignment between spear point 750 and drive socket 531, the alignment faces 532B and 754B engage and urge the spear point and drive socket into the correct relative rotational orientation.

The lower docking arm's vertical translation is arrested by engagement of the lower surface of stop pads 560 with the upper surface 724 of container lid plate 721. In this upper, operating position 806 of the container, the spear point and drive socket are operably engaged (see FIGS. 13B and 13E). Openings 544A–B allow visual inspection of the engagement. In the operating position, the container is clamped between the upper and lower docking arms by engagement of the upper surfaces of the forks with the upper inside surfaces of the rails and by engagement of the stop pads with the container lid plate. Shifting of the container within the docking assembly 140 is inhibited both by frictional forces between the stop pad and plate lid and between the forks and rails, and by radial bearing forces of the bearing block against the guide ring.

During operation, the docking assembly 140 is rotated about horizontal rotation axis 132 by motor 120 while the impeller with mixing blades within container 700 is rotated about the vertical axis of rotation 522 by drive motor 510.

The forks, guide pins, and guide stop collar of the invention provide reliable, accurate axial alignment of spear point 750 and drive socket 531 in the operating position of the container. Engagement of the guide stop collar with the container lid also provides for precise axial positioning of the spear point within the drive socket. These alignment accuracies allow the drive coupling 530 to be rigid (rather than spring-mounted as in the prior art systems), which permits greater power transmission. Furthermore, the screw jack system for the lower docking arm drive is mechanically simpler while at least as safe as the prior art hydraulic lift systems. The forks and screw drive components are readily available from commercial sources and are less expensive to purchase or manufacture than the prior art docking arms and drives.

Although in the illustrated embodiment the upper docking arm is fixed and the lower docking arm is moveable, it is contemplated that the upper docking arm could move downwardly to engage the lid of the container, which could be placed on a fixed lower docking arm. Further, although it is preferred to combine the features of the forked lower docking arm with positioning pins, screw jack docking arm drive, and guide stop collar, these features offer advantages individually over the prior art, and may be used individually with prior art counterparts to the other features. The guiding and stopping/clamping functions of the guide stop collar can also be separated from each other, so that a guide collar could be used to ensure alignment of the impeller rotation and impeller drive rotation axes while using conventional structural arrangements to clampingly engage the upper end of the container with the upper docking arm. The invention can also be used in the context of a prior art system in which the impeller axis of rotation is angled, rather than vertical.

What is claimed is:

1. A mixer comprising:

a container having an impeller mounted therein for rotation, said impeller having a drive end; p1 a docking assembly having a first arm, a second arm, and a docking assembly drive coupled to one of said first and second arms to selectively move said one of said first and second arms toward the other of said first and second arms;

an impeller drive mounted to said first arm, said impeller drive having a drive socket engageable with said impeller drive end; and a circumferential guide mounted to said first arm concentrically about said drive socket and being engageable with said container to circumferentially align said impeller drive end with said drive socket, wherein said impeller drive end is circumferentially aligned by the circumferential guide prior to engaging said drive socket.

2. The mixer of claim 1 wherein said circumferential guide comprises a cylindrical side wall depending from said first arm terminating in a free end and having a conical entry portion disposed circumferentially about said free end.

3. The mixer of claim 1 wherein:

said container includes a first and second laterally spaced hollow frame members; and said second arm includes first and second laterally spaced elongate members receivable in said hollow frame members.

4. The mixer of claim 3 wherein:

each of said hollow frame members includes a guide hole; and each of said elongate members includes a guide post engageable with said guide hole to position said container on said elongate members.

5. The mixer of claim 1 wherein said docking assembly drive is coupled to said second arm to selectively move said second arm toward said first arm.

6. A mixer comprising:

a container having an impeller mounted therein for rotation, said impeller having a drive end;

a docking assembly having a first arm, a second arm, and a docking assembly drive coupled to one of said first and second arms to selectively move said one of said first and second arms toward the other of said first and second arms;

an impeller drive mounted to said first arm, said impeller drive having a drive socket engageable with said impeller drive end; and means mounted to said first arm concentrically about said drive socket for engaging said container and circumferentially aligning said impeller drive end with said drive socket, wherein said impeller drive end is circumferentially aligned by the means for engaging said container and circumferentially aligning said impeller drive end with said drive socket prior to engaging said drive socket.

7. The mixer of claim 6 wherein said means for engaging said container and aligning said impeller drive end with said drive socket comprises a guide stop collar with a guide ring and at least one stop pad.

8. The mixer of claim 7 wherein said guide ring includes a conical entry portion and a cylindrical exit portion.

9. The mixer of claim 6 wherein said docking assembly drive is coupled to said second arm to selectively move said second arm toward said first arm.

10. A mixer comprising:

a container having a removable lid and an impeller mounted therein for rotation, said impeller having a drive end extending through said lid;

a docking assembly having a first arm, a second arm, and a docking assembly drive coupled to one of said first and second arms to selectively move said one of said first and second arms toward the other of said first and second arms;

an impeller drive mounted to said first arm, said impeller drive having a drive socket engageable with said impeller drive end; and a circumferential stop collar mounted to said said first arm concentrically about said drive socket and being engageable with said container lid to clampingly retain said container between said second arm and said stop collar.

11. The mixer of claim 10 wherein said docking assembly drive is coupled to said second arm to selectively move said second arm toward said first arm.

12. A method of operably engaging a drive socket of a mixing station having a docking assembly with first and second arms, the drive socket being mounted on the first arm and having a circumferential guide mounted proximate to the drive socket, with an impeller mounted for rotation within a mixing container and having an impeller drive end, comprising the steps of:

engaging the container on the second arm;

moving one of said first and second arms toward the other of said first and second arms;

engaging the container with the circumferential guide to position the impeller drive end substantially coaxially with the drive socket; and after engaging the container with the circumferential guide, engaging the impeller drive end with the drive socket.

13. The method of claim 12 further comprising the steps of:

disposing a guide post on the second arm;

disposing a guide hole on the container; and engaging the guide post with the guide hole to position the container on the second arm.

* * * * *

UNITED STATES PATENT AND TRADEMARK OFFICE

CERTIFICATE OF CORRECTION

PATENT NO. : 5,865,538

DATED : February 2, 1999

INVENTOR(S) : Thomas R. Walker et al.

It is certified that error appears in the above-indentified patent and that said Letters Patent is hereby corrected as shown below:

Column 7, line 55, "end; p1 a docking" should be --end; a docking--.

Signed and Sealed this

Sixth Day of July, 1999

*Attest:*

Q. TODD DICKINSON

*Attesting Officer*

*Acting Commissioner of Patents and Trademarks*